US005773968A

United States Patent [19]

Kondo et al.

[11] Patent Number: 5,773,968

[45] Date of Patent: Jun. 30, 1998

[54] INTERNAL VOLTAGE CONVERSION CIRCUIT

[75] Inventors: Hideaki Kondo, Kyoto; Akinori Shibayama, Hirakata, both of Japan

[73] Assignee: Matsushita Electronics Corporation, Osaka, Japan

[21] Appl. No.: 716,786

[22] Filed: Sep. 11, 1996

[30] Foreign Application Priority Data

Sep. 21, 1995 [JP] Japan ..... 7-242743

[51] Int. Cl.[6] ..... G05F 3/16

[52] U.S. Cl. ..... 323/316; 323/317; 327/541; 327/539; 327/544; 327/543

[58] Field of Search ..... 323/313, 314, 323/315, 316, 317; 327/535, 537, 540, 541, 542, 543, 539, 544

[56] References Cited

U.S. PATENT DOCUMENTS

| | | | |
|---|---|---|---|
| 5,254,880 | 10/1993 | Horiguchi et al. | 327/530 |
| 5,434,498 | 7/1995 | Cordoba et al. | 323/313 |
| 5,545,977 | 8/1996 | Yamada et al. | 323/313 |

FOREIGN PATENT DOCUMENTS 6-208791 7/1994 Japan .

*Primary Examiner*—Peter S. Wong
*Assistant Examiner*—Shawn Riley
*Attorney, Agent, or Firm*—McDermott, Will & Emery

[57] ABSTRACT

A voltage conversion circuit that includes a reference voltage generation circuit, an output circuit, and an output control circuit. The reference voltage generation circuit outputs a first reference voltage and a second reference voltage which is higher than the first reference voltage by a predetermined voltage. Based on the first reference voltage, the output circuit outputs an internally converted voltage. The output control circuit reduces the internally converted voltage when the control circuit outputs a higher internally converted voltage than the second reference voltage. In accordance with the voltage conversion circuit, even when there occurs an increase in the internally converted voltage due to the flow of very small leakage currents between an external power supply and the internal voltage conversion circuit, the internally converted voltage is lowered by the output control circuit when it exceeds the second reference voltage output from the reference voltage generation circuit. This prevents an excess increase in the internally converted voltage, which ensures that internal elements in the semiconductor integrated circuit can be fed a stable voltage.

10 Claims, 8 Drawing Sheets

INTERNAL VOLTAGE CONVERSION CIRCUIT

BACKGROUND OF THE INVENTION

This invention relates to an internal voltage conversion circuit contained in a semiconductor integrated circuit such as DRAM (dynamic random access memory).

The semiconductor industry has been trying to develop semiconductor integrated circuits containing therein an internal voltage conversion circuit for achieving low-power operations and for securing the reliability of internal elements of the semiconductor integrated circuits. Based on $V_{cc}$ (the external power supply voltage), the internal voltage conversion circuit generates and provides a lower voltage than $V_{cc}$. This voltage is called an internally converted voltage. By supplying such an internally converted voltage to the internal elements, it becomes possible to realize low-power operations and to secure the reliability of the internal elements.

Japanese Patent Application Pub. No. 6-208791 shows an internal voltage conversion circuit capable of coping with operation modes that require power savings.

FIG. 8 is a block diagram showing a conventional internal voltage conversion circuit 50. Here, the internal voltage conversion circuit 50 is contained in a DRAM. 51 is a reference voltage generation circuit. The reference voltage generation circuit 51 generates both a first reference voltage $V_{ref1}$ and a second reference voltage $V_{ref2}$. 52 is a first differential amplification circuit. 53 is a first output driver. A first internally converted voltage $V_{int1}$ is produced by the circuit 52 and the driver 53 on the basis of $V_{ref1}$. 54 is a second differential amplification circuit. 55 is a second output driver. A second internally converted voltage $V_{int2}$ is produced by the circuit 54 and the driver 55 on the basis of $V_{ref2}$. Since $V_{ref2}$ is lower than $V_{ref1}$, $V_{int2}$ becomes lower than $V_{int1}$.

56 is an operation mode switch circuit. 57 is an operation mode selection circuit. The operation mode switch circuit 56 provides either $V_{int1}$ or $V_{int2}$ as an internally converted voltage ($V_{int}$) according to an operation mode signal from the operation mode selection circuit 57. The operation mode selection circuit 57 brings a first operation mode signal model into the level of HIGH when the DRAM performs normal operations (i.e., when the DRAM is in normal operation mode). On the other hand, when the DRAM performs no high-speed operations such as "refresh" (when the DRAM is in low power consumption mode), the operation mode selection circuit 57 brings a second mode signal mode2 into the level of HIGH.

In a normal mode, SIGNAL model becomes HIGH and therefore the operation mode switch circuit 56 selects $V_{int1}$ which is then output as $V_{int}$. On the other hand, in a low power consumption mode, SIGNAL mode2 becomes HIGH and therefore the operation mode switch circuit 56 selects $V_{int2}$ which is then output as $V_{int}$.

As described above, the internal voltage conversion circuit 50 of FIG. 8 is capable of selecting between two different voltages ($V_{int1}$ and $V_{int2}$) and providing a selected one as $V_{int}$.

Commonly-used internal voltage conversion circuits, however, have the following drawbacks.

In a conventional internal voltage conversion circuit, an internally converted voltage is generated by (a) a differential amplification circuit which amplifies a difference between predetermined reference voltage and internally converted voltage and (b) an output driver which increases the potential of output from the differential amplification circuit. In other words, the conventional internal voltage conversion circuit has no function of reducing the internally converted voltage. This produces the problem that, if a very small leakage current flows between an external power supply and the internal voltage conversion circuit when DRAM internal elements are in the standby state and if there is no power supply from the internal voltage conversion circuit, then the internally converted voltage greatly exceeds the predetermined reference voltage.

In addition to such a problem, the conventional internal voltage conversion circuit requires two individual differential amplification circuits and two individual output drivers for making it possible to perform a selection between two different voltages. This results in increasing the power consumption and the circuit area.

SUMMARY OF THE INVENTION

In an internal voltage conversion circuit of the present invention, an output control circuit is provided which reduces, when an internally converted voltage output exceeds a predetermined upper-limit reference voltage, the internally converted voltage, thereby preventing the internally converted voltage from excessively increasing.

Additionally, in an internal voltage conversion circuit of the present invention, an output circuit is provided which selects among a plurality of different reference voltages and outputs, based on the selected one, an internally converted voltage. This makes it possible to provide a selected one of a plurality of internally converted voltages and, additionally, to realize a low-power, circuit area saving internal voltage conversion circuit.

The present invention provides an internal voltage conversion circuit which is contained in a semiconductor integrated circuit and which feeds to an internal element of the semiconductor integrated circuit an internally converted voltage which is lower than an external power supply voltage, the internal voltage conversion circuit comprising:

a reference voltage generation circuit which generates a first reference voltage and a second reference voltage which is higher than the first reference voltage by a predetermined voltage;

an output circuit which outputs the internally converted voltage on the basis of the first reference voltage output from the reference voltage generation circuit; and an output control circuit which reduces, when the internally converted voltage increases in excess of the second reference voltage generated by the reference voltage generation circuit, the excess internally converted voltage.

In accordance with the internal voltage conversion circuit of the present invention, even when there occurs an increase in the internally converted voltage due to the flow of very small leakage currents between an external power supply and the internal voltage conversion circuit, the internally converted voltage is stepped down by the output control circuit when it exceeds the second reference voltage provided from the reference voltage generation circuit. This prevents an excess increase in the internally converted voltage, whereby internal elements of a semiconductor integrated circuit can be fed a constant voltage. Additionally, stress to the internal elements can be reduced.

The present invention provides an internal voltage conversion circuit which is contained in a semiconductor integrated circuit and which feeds to an internal element of the semiconductor integrated circuit an internally converted voltage which is lower than an external power supply voltage, the internal voltage conversion circuit comprising:

a reference voltage generation circuit which generates a first reference voltage and a second reference voltage; and an output circuit which selects between the first reference voltage and the second reference voltage generated by the reference voltage generation circuit and which outputs the internally converted voltage on the basis of a selected reference voltage.

In accordance with this internal voltage conversion circuit, a selection between an internally converted voltage based on the first reference voltage and another based on the second reference voltage can be made by means of a single output circuit. This arrangement makes it possible to provide a low power, circuit area saving internal voltage conversion circuit.

DETAILED DESCRIPTION OF THE INVENTION

With reference to the accompanying drawings, internal voltage conversion circuits of preferred embodiments of the present invention are now described below.

First Embodiment

An internal voltage conversion circuit of the first embodiment intends to prevent an excess increase in the internally converted voltage due to, for example, the flow of very small leakage currents between the internal voltage conversion circuit and an external power supply.

Figure 1:
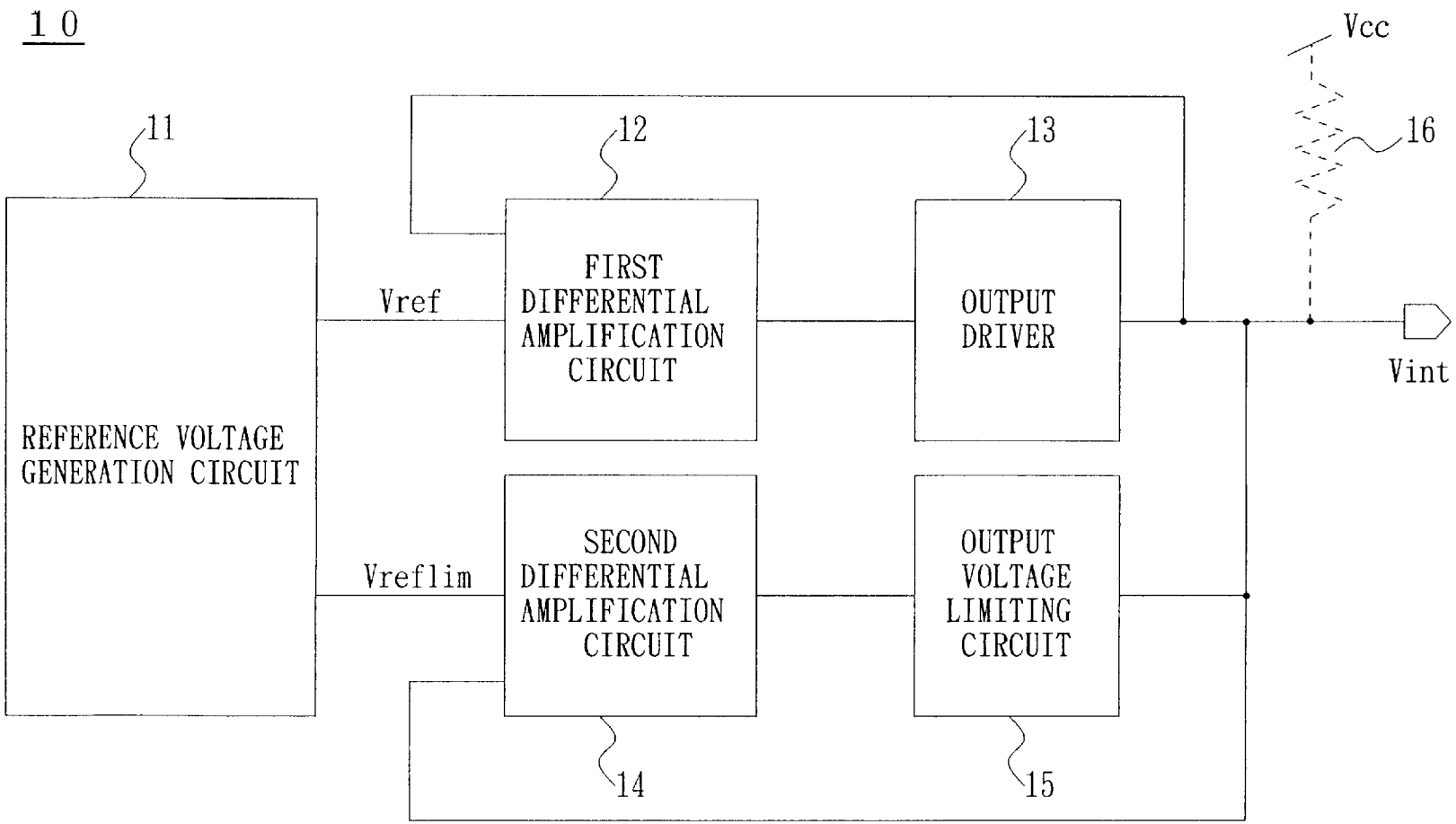
FIG. 1 is a block diagram showing the configuration of an internal voltage conversion circuit in accordance with a first embodiment of the present invention.

Referring now to FIG. 1, there is shown in block form an internal voltage conversion circuit 10. The internal voltage conversion circuit 10 is a circuit which is contained in a DRAM and which applies $V_{int}$ (the internally converted voltage) as supply power to internal elements of the DRAM. This internal voltage conversion circuit 10 comprises a reference voltage generation circuit 11, a first differential amplification circuit 12, an output driver 13, a second differential amplification circuit 14 and an output voltage limiting circuit 15. The first differential amplification circuit 12 and the output driver 13 together constitute an output circuit. The second differential amplification circuit 14 and the output voltage limiting circuit 15 together constitute an output control circuit. 16 is a parasitic resistance between an output terminal of the internal voltage conversion circuit and the external power supply and there is shown that a very small leakage current flows between the internal voltage conversion circuit and the external power supply.

Figure 8:
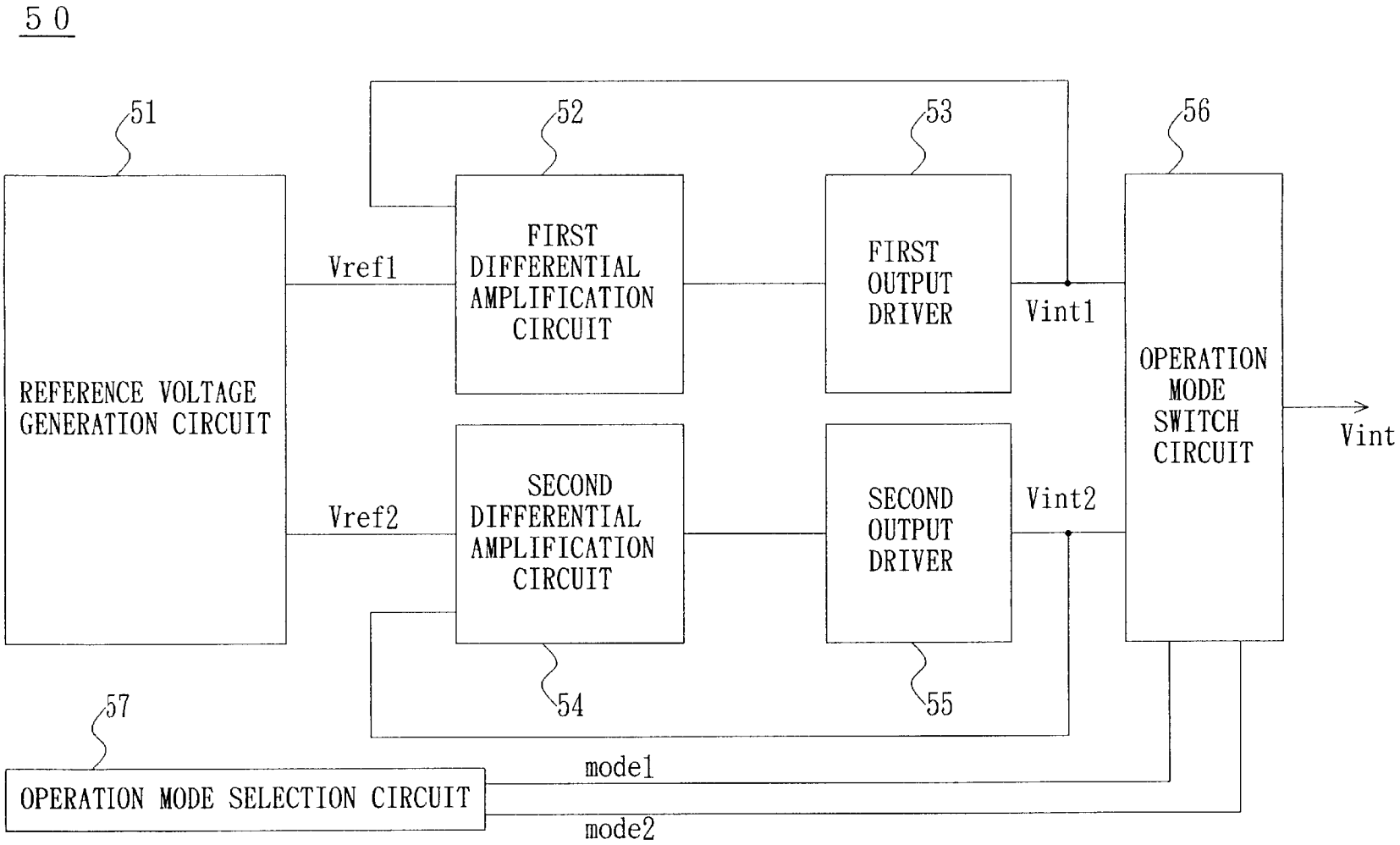
FIG. 8 PRIOR ART
FIG. 8 is a block diagram showing the configuration of a conventional internal voltage conversion circuit.

The reference voltage generation circuit 11, which is a CMOS-structure circuit, generates and provides a reference voltage $V_{ref}$ serving as a first reference voltage which depends lightly on $V_{cc}$ (the external power supply voltage). The circuit 11 provides and generates also an upper limit reference voltage $V_{reflim}$ serving as a second reference voltage which is higher than $V_{ref}$ by a predetermined potential. The first differential amplification circuit 12 and the output driver 13 are identical in configuration with the first differential amplification circuit 52 and with the first output driver 53 of FIG. 8, respectively. The first differential amplification circuit 12 amplifies a difference between $V_{ref}$ (reference voltage) and $V_{int}$ (internally converted voltage). The output driver 13 comprising PMOS transistors drives $V_{int}$ according to the output voltage of the first differential amplification circuit 12.

The second differential amplification circuit 14 amplifies a difference between $V_{reflim}$ and $V_{int}$. The output voltage limiting circuit 15 controls $V_{int}$ according to the output voltage of the second differential amplification circuit 14.

The operation of the internal voltage conversion circuit 10 shown in FIG. 1 is now described. $V_{int}$ is generated on the basis of $V_{ref}$ supplied from the reference voltage generation circuit 11, by the first differential amplification circuit 12 and the output driver 13. If $V_{int}$ exceeds $V_{reflim}$ due to a very small leakage current flow between the external power supply and the internal voltage conversion circuit 10 or due to a variation in the external ground power supply voltage, the second differential amplification circuit 14 operates and the output voltage limiting circuit 15 reduces $V_{int}$ to a voltage level below $V_{reflim}$.

Figure 2:
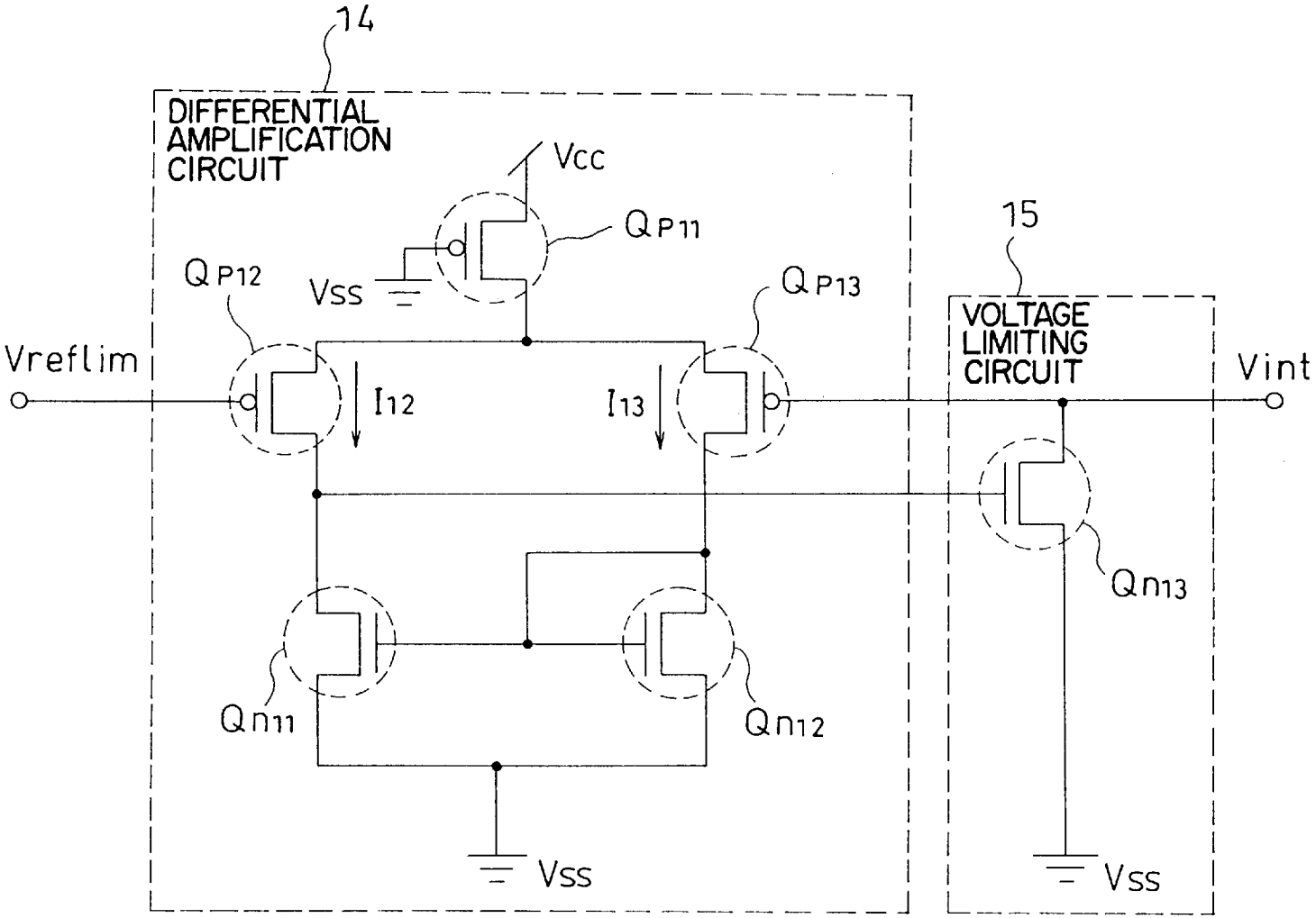
FIG. 2 shows in circuit diagram form a second differential amplification circuit and an output voltage limiting circuit in the FIG. 1 internal voltage conversion circuit.

With reference to FIG. 2, the second differential amplification circuit 14 and the output voltage limiting circuit 15 are illustrated in the form of a circuit diagram. The circuit of FIG. 2 is a CMOS-structure circuit. The second differential amplification circuit 14 comprises the following elements: a p-type MOS transistor (PMOS) Qp11 as an electric current source; PMOS Qp12 as a first MOS transistor of one conductivity type; PMOS Qp13 as a second MOS transistor of one conductivity type; an n-type MOS transistor (NMOS) Qn11 as a first MOS transistor of the other conductivity type and NMOS Qn12 as a second MOS transistor of the other conductivity type. The output voltage limiting circuit 15 comprises an NMOS Qn13.

The sources of NMOS Qn11 and NMOS Qn12 are connected to $V_{ss}$ (the ground power supply), and the gates of NMOS Qn11 and NMOS Qn12 and the drain of NMOS Qn12 are connected together forming a current mirror circuit. The source and the gate of PMOS Qp11 are connected to $V_{cc}$ (the external power supply) and to $V_{ss}$ (the ground power supply), respectively so that PMOS Qp11 acts as a constant current source. The drain of PMOS Qp11 and the sources of PMOS Qp12 and PMOS Qp13 are connected together to constitute a differential amplifier. PMOS Qp12 and NMOS Qn11 are connected together drain to drain. PMOS Qp13 and NMOS Qn12 are connected together drain to drain. $V_{reflim}$, which is the first input of the second differential amplification circuit 14, is applied to the gate of PMOS Qp12. $V_{int}$, which is the second input of the second differential amplification circuit 14, is applied to the gate of PMOS Qp13.

NMOS Qn13, which constitutes the output voltage limiting circuit 15, has a gate at which the drain voltage of PMOS Qp12 (i.e., the drain voltage of NMOS Qn11) is applied. The source of NMOS Qn13 is grounded. The drain voltage of NMOS Qn13 is output as $V_{int}$ and is applied to the gate of PMOS Qp13.

The operation principle of the FIG. 2 circuit is explained. Suppose that $V_{int}$ increases and exceeds $V_{reflim}$. In this case, the gate-source voltage of PMOS Qp12 becomes greater than that of PMOS Qp13, as a result of which a drain current $I_{12}$ flowing through PMOS Qp12 becomes greater than a drain current $I_{13}$ flowing through PMOS Qp13. At this time, the drain voltage of NMOS Qn11 is greater than that of NMOS Qn12, which causes NMOS Qn13 to conduct, and the drain voltage of NMOS Qn13 (i.e., $V_{int}$) drops.

When $V_{int}$ drops, almost to $V_{reflim}$, the gate-source voltage of PMOS Qp13 increases, and the drain current of PMOS Qp13 ($I_{13}$) increases while the drain current of PMOS Qp12 ($I_{12}$) decreases. At this time, the drain voltage of NMOS Qn11 decreases, as a result of which NMOS Qn13 enters the nonconductive state and $V_{int}$ stops dropping.

Figure 3:
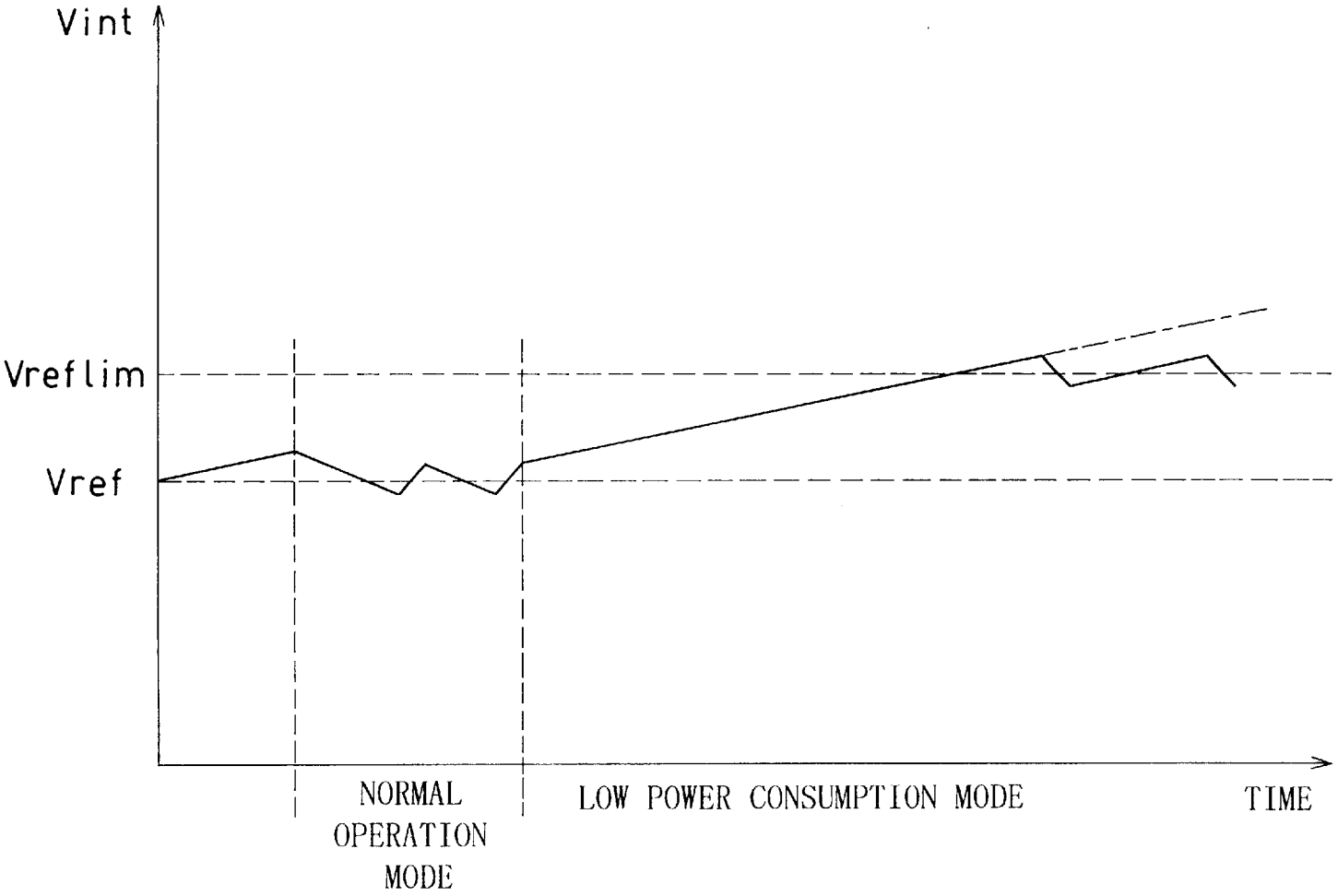
FIG. 3 is a graph showing variations in the internally converted voltage generated in the FIG. 1 internal voltage conversion circuit.

FIG. 3 is a graphic diagram showing variations in the internally converted voltage ($V_{int}$) generated by the internal voltage conversion circuit of the present embodiment. As shown in FIG. 3, $V_{int}$, when it decreases due to power consumption by internal elements of the DRAM in a normal operation mode, is driven by the first differential amplification circuit 12 and the output driver 13 on the basis of $V_{ref}$. On the other hand, when no power is consumed by these internal elements in a low power consumption mode, $V_{int}$ gradually increases because of, for example, very small leakage currents. It is impossible for a conventional internal voltage conversion circuit to prevent an excess increase in $V_{int}$ shown in FIG. 3 by alternate long and short dash line. In the internal voltage conversion circuit of the present invention, it is possible to control $V_{int}$ by the second differential amplification circuit 14 and the output voltage limiting circuit 15, on the basis of $V_{reflim}$.

The value of $V_{ref}$ and $V_{reflim}$ for an actual internal voltage conversion circuit is described. Suppose here that an internal element, the specification power supply voltage of which is 3.3 V, is contained in a semiconductor integrated circuit whose external power supply is 5 V and that an internal voltage conversion circuit which supplies a power supply voltage to the internal element is provided. The specification of a voltage range, within which the internal element is guaranteed to normally operate, is 3.3±0.3 V so that the internal element is able to operate with stability if $V_{ref}$=3.3 V and $V_{rflim}$=3.6 V.

The addition of the output control circuit for reducing $V_{int}$ prevents an excess increase in $V_{int}$.

Second Embodiment

Figure 4:
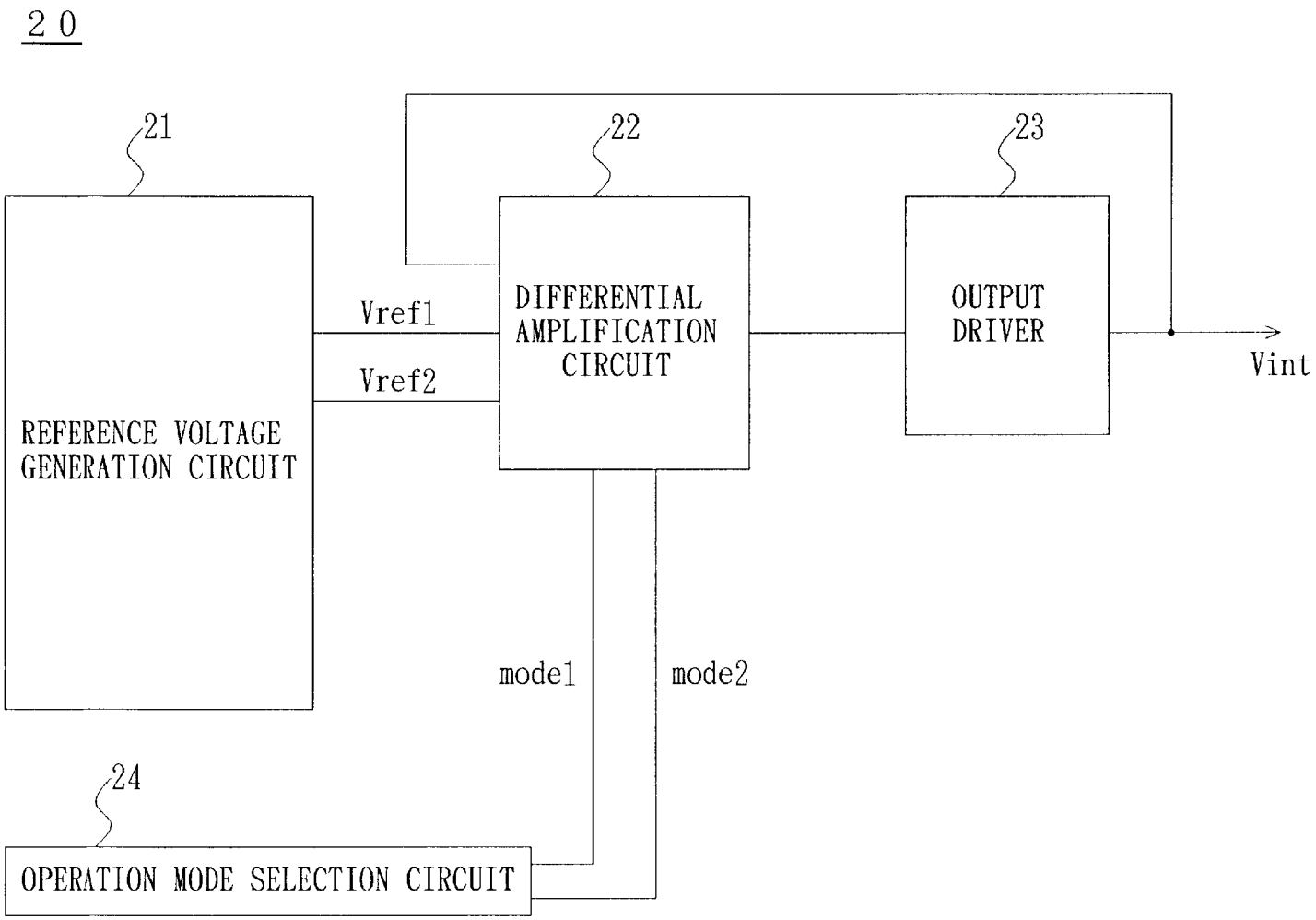
FIG. 4 is a block diagram showing the configuration of an internal voltage conversion circuit in accordance with a second embodiment of the present invention.

FIG. 4 shows in block form an internal voltage conversion circuit 20 in accordance with the second embodiment of the present invention.

The internal voltage conversion circuit 20 of FIG. 4 is a circuit for applying $V_{int}$ as supply power to DRAM internal elements. This internal voltage conversion circuit 20 comprises a reference voltage generation circuit 21, a differential amplification circuit 22, an output driver 23, and an operation mode selection circuit 24.

The reference voltage generation circuit 21 generates $V_{ref1}$ (the first reference voltage) for the normal operation mode and $V_{ref2}$ (the second reference voltage) for the low power consumption mode. This circuit 21 may be implemented by a CMOS-structure circuit such as one shown in Japanese Patent Application Pub. No. 6-208791.

The operation mode selection circuit 24 generates a first operation mode signal model indicative of a normal operation mode and a second operation mode signal mode2 indicative of a low power consumption mode. The differential amplification circuit 22 selects between $V_{ref1}$ and $V_{ref2}$ according to SIGNALS model and mode2 and amplifies a difference between a selected reference voltage ($V_{ref1}$ or $V_{ref2}$, whichever is selected) and $V_{int}$. The output driver 23 is controlled by the output voltage from the differential amplification circuit 22 and provides $V_{int}$.

The operation of the internal voltage conversion circuit 20 shown in FIG. 4 is illustrated.

In a normal operation mode, $V_{ref1}$ is chosen as the first input of a differential amplifier forming the differential amplification circuit 22, in response to SIGNAL model from the operation mode selection circuit 24, and $V_{int}$ is driven by the output driver 23 to $V_{ref1}$. On the other hand, in a low power consumption mode, $V_{ref2}$ is chosen as the first input of the differential amplifier, in response to SIGNAL mode2 from the operation mode selection circuit 24, and $V_{int}$ is driven by the output driver 23 to $V_{ref2}$.

The differential amplification circuit 22 is formed such that the first input of the differential amplifier is switched by operation mode. Conventionally, a set of one differential amplification circuit and one output driver is required for each operation mode. One feature of the present embodiment is that the number of differential amplification circuits required and the number of output drivers required are reduced to one. Accordingly, the consumption power is reduced and the layout area is saved.

Figure 5:
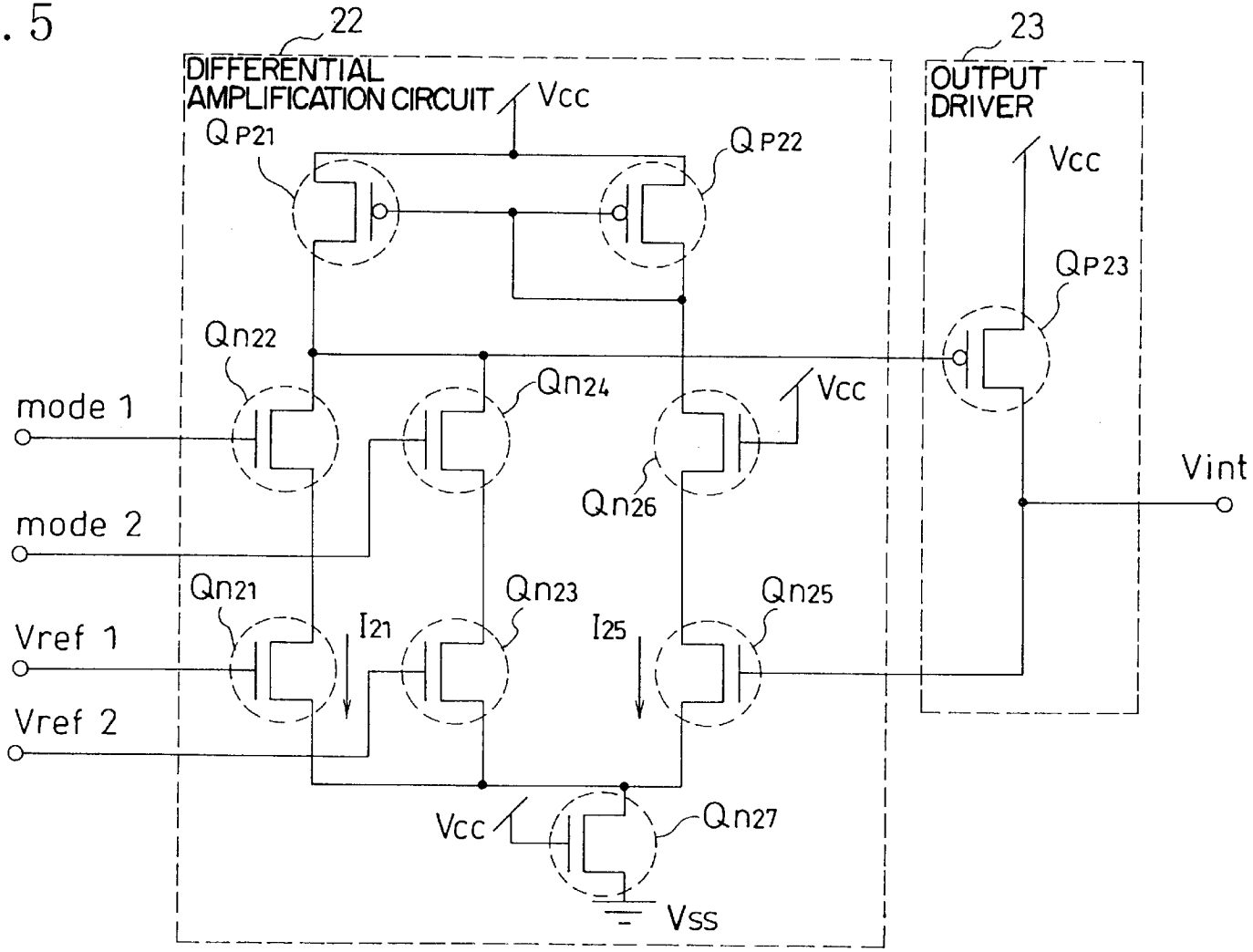
FIG. 5 shows in circuit diagram form a differential amplification circuit and an output driver in the FIG. 4 internal voltage conversion circuit.

FIG. 5 shows, in the form of a circuit diagram, the differential amplification circuit 22 and the output driver 23 of FIG. 4. The circuit shown in FIG. 5 is a CMOS-structure circuit. The differential amplification circuit 22 comprises the following elements: PMOS Qp21 as a first MOS transistor of the other conductivity type; PMOS Qp22 as a second MOS transistor of the other conductivity type; NMOS Qn21 as a first MOS transistor of one conductivity type; NMOS Qn22 as a second MOS transistor of one conductivity type; NMOS Qn23 as a third MOS transistor of one conductivity type; NMOS Qn24 as a fourth MOS transistor of one conductivity type; NMOS Qn25 as a fifth MOS transistor of one conductivity type; NMOS Qn26 as a sixth MOS transistor of one conductivity type; and NMOS Qn27 that acts as an electric current source. The output driver 23 is formed of PMOS Qp23.

The sources of PMOS Qp21 and PMOS Qp22 are connected to $V_{cc}$ (the external power supply), and the gates of PMOS Qp21 and PMOS Qp22 and the drain of PMOS Qp22 are connected together forming a current mirror circuit.

$V_{ref1}$ is fed to the gate of NMOS Qn21. SIGNAL model is applied to the gate of NMOS Qn22. $Vref_2$ is fed to the gate of NMOS Qn23. SIGNAL model is applied to the gate of NMOS Qn24. The drain of NMOS Qn21 and the source of NMOS Qn22 are connected in series. The drain of NMOS Qn23 and the source of NMOS Qn24 are connected in series. The sources of NMOS Qn21 and NMOS Qn23 are connected to the drain of NMOS Qn27. The drains of NMOS Qn22 and NMOS Qn24 are connected to the drain of PMOS Qp21.

The gate of NMOS Qn25 is fed $V_{int}$ (the internally converted voltage). The gate of NMOS Qn26 is fed $V_{cc}$ (the external power supply voltage). The drain of NMOS Qn25 and the source of NMOS Qn26 are connected in series. NMOS Qn26 and PMOS Qp22 are connected together drain to drain. The source of NMOS Qn25 is connected to the drain of NMOS Qn27. NMOS Qn27, the source of which is grounded and which receives $V_{cc}$ at the gate, therefore acts as a constant current source. In this way, the differential amplifier is formed.

The source and the gate of PMOS Qp23 constituting the output driver 23 are connected to $V_{cc}$ and to the drains of NMOS Qn22 and NMOS Qn24, respectively. The drain voltage of PMOS Qp23 is provided as $V_{int}$ and is applied to the gate of NMOS Qn25.

The operation principle of the FIG. 5 circuit is described.

In a normal operation mode, SIGNAL model becomes HIGH, which causes NMOS Qn22 to conduct, while SIGNAL mode2 becomes LOW thereby causing NMOS Qn24 to enter the nonconductive state. Therefore, only $V_{ref1}$ becomes valid as the first input of the differential amplifier.

When $V_{int}$ is lower than $V_{ref1}$, $I_{21}$ (the drain current of NMOS Qn21) is made by the differential amplifier greater than $I_{25}$ (the drain current of NMOS Qn25). Because of this, the source-drain voltage of PMOS Qp21 becomes greater than that of PMOS Qp22 (PMOS Qp21 and PMOS Qp22 form a current mirror circuit) and, as a result, PMOS Qp23 conducts thereby increasing $V_{int}$. As $V_{int}$ increases, $I_{25}$, likewise increases and $I_{21}$ decreases. As a result, the source-drain voltage of PMOS Qp22 is increased and the source-drain voltage of PMOS Qp21 is decreased, by the differential amplifier. PMOS Qp23 enters the nonconductive state and $V_{int}$ stops increasing. In other words, $V_{int}$ is driven, almost to $V_{ref1}$.

In a low power consumption mode, SIGNAL mode2 becomes HIGH, which causes NMOS Qn24 to conduct, while on the other hand SIGNAL model becomes LOW therefore causing NMOS Qn22 to enter the nonconductive state. As a result, only $V_{ref2}$ becomes valid as the first input of the differential amplifier. The operation of generating $V_{int}$ in the low power consumption mode is the same as the operation of generating $V_{int}$ in the normal operation mode.

The present embodiment makes it possible for a single differential amplifier capable of putting in a plurality of reference voltages to realize functions which, in a prior art technique, are performed by a plurality of differential amplifiers. Accordingly, a low power, layout area saving internal voltage conversion circuit is realized.

Additionally, a combination of the present embodiment and the first embodiment may be used. More specifically, $V_{ref1}$ and $V_{reflim1}$ are given in a normal operation mode, while $V_{ref2}$ and $V_{reflim2}$ are given in a low power consumption mode.

Third Embodiment

There is a possibility that, at the time of changing an operation mode in the FIG. 5 circuit, both NMOS Qn22 and NMOS Qn24 conduct at some timing of switching an operation mode signal. If both of NMOS Qn22 and NMOS Qn24 conduct, then an excess current flows in the output terminal resulting in causing $V_{int}$ to exceed a reference voltage. For example, at the time of a change from normal operation mode to low power consumption mode, there occurs a phenomenon that $V_{int}$ exceeds $V_{ref1}$. In other words, there is produced the problem that an excess increase in $V_{int}$ occurs.

An internal voltage conversion circuit of the present embodiment solves the above-described problem. More specifically, operation mode signals are controlled in such a way as to prevent NMOS Qn22 and NMOS Qn24 from simultaneously conducting when an operation mode is switched.

Figure 6:
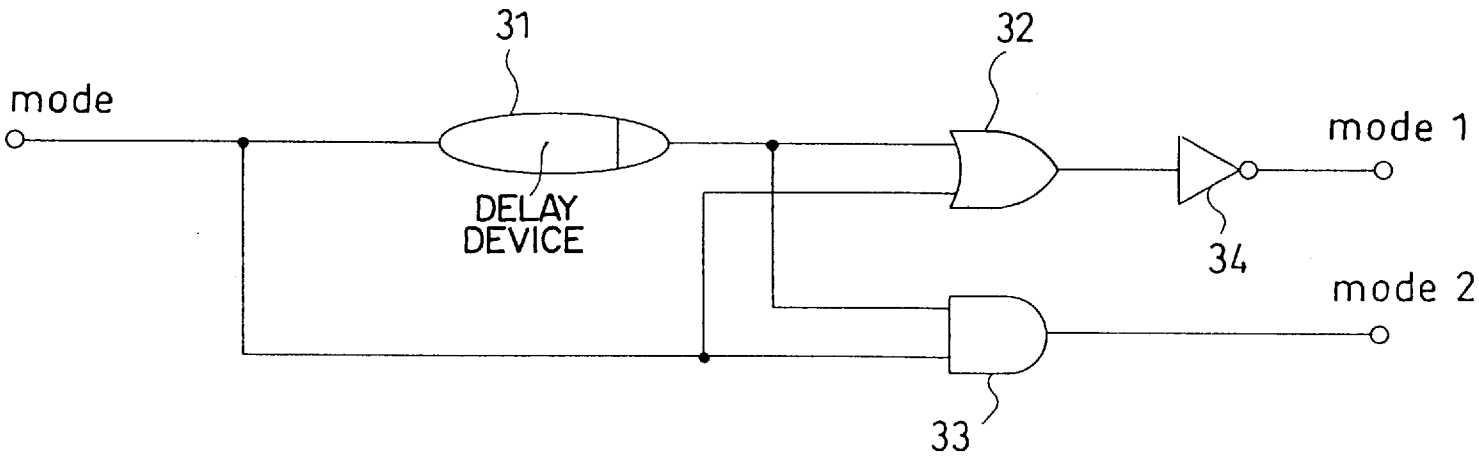
FIG. 6 is a circuit diagram of an operation mode selection circuit in an internal voltage conversion circuit in accordance with a third embodiment of the present invention.

FIG. 6 illustrates, in the form of a circuit diagram, the internal voltage conversion circuit of the present embodiment. 31 is a delay device. 32 is an OR circuit. 33 is an AND circuit. 34 is an inverter.

An external operation signal mode is directly fed to the OR circuit 32 and the AND circuit 33 and is indirectly fed to the OR circuit 32 and the AND circuit 33 through the delay device 31. An output signal from the OR circuit 32 is inverted by the inverter 34 and is thereafter provided as a first operation mode signal model, and an output signal from the AND circuit 33 is provided as a second operation mode signal mode2.

When SIGNAL mode is LOW, SIGNAL model is HIGH and SIGNAL mode2 is LOW. On the other hand, when SIGNAL mode is HIGH, then SIGNAL model is LOW and SIGNAL mode2 is HIGH.

The operation of the operation mode selection circuit shown in FIG. 6 is described.

Figure 7:
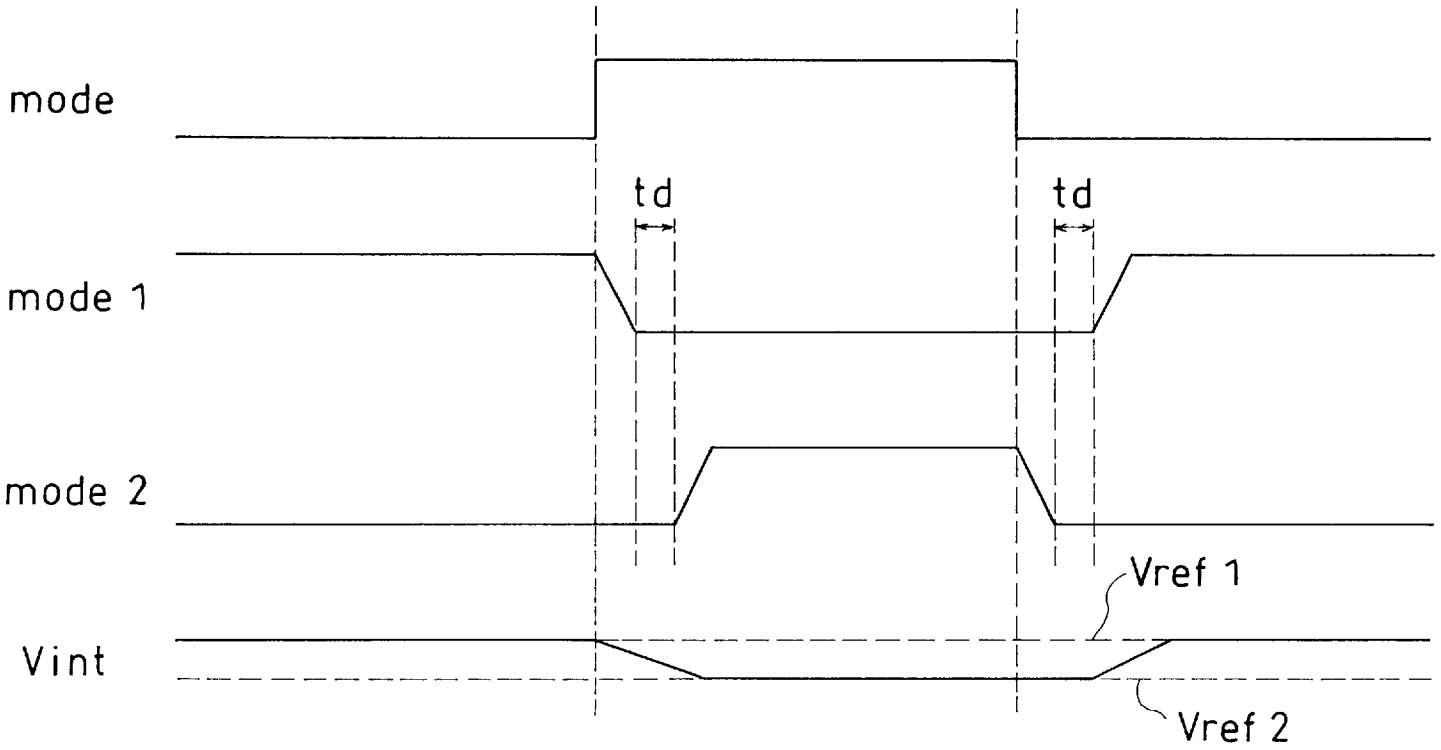
FIG. 7 is a timing diagram useful in understanding the operation of the FIG. 6 operation mode selection circuit.

FIG. 7 is a timing diagram showing the operation of the FIG. 6 operation mode selection circuit. When SIGNAL mode changes from LOW to HIGH, SIGNAL model changes from HIGH to LOW. However, SIGNAL mode2 changes to HIGH after an elapse of a delay time $t_d$ by the delay device 31. The differential amplification circuit is in the stopped state when both SIGNAL model and SIGNAL mode2 are LOW, and $V_{int}$ gradually drops because of the supply of power to the DRAM internal elements. When SIGNAL mode2 becomes HIGH, $V_{int}$ becomes approximately equal to $V_{ref2}$.

When SIGNAL mode changes from HIGH to LOW, SIGNAL mode2 changes from HIGH to LOW. However, SIGNAL model changes to HIGH after an elapse of $t_d$ by the delay device 31. The differential amplification circuit is in the stopped state when both SIGNAL model and SIGNAL mode2 are LOW and there is no increase in $V_{int}$. When SIGNAL model becomes HIGH, $V_{int}$ increases up to $V_{ref1}$.

In accordance with the present embodiment, it is designed such that the differential amplification circuit is placed into the stopped state when there is made a change in the operation mode, whereby an excess increase in the internally converted voltage can be prevented. This reduces the amount of power used by the internal voltage conversion circuit.

Each embodiment of the present invention has been described in terms of the internal voltage conversion circuits for use by DRAM. However, the present internal voltage conversion circuit may find applications in semiconductor integrated circuits of different types. For example, the present internal voltage conversion circuit may be used to supply power to a readout circuit of an EEPROM.

The invention claimed is:

1. An internal voltage conversion circuit which is contained in a semiconductor integrated circuit and which feeds to internal elements of said semiconductor integrated circuit an internally converted voltage which is lower than an external power supply voltage, said internal voltage conversion circuit comprising:

a reference voltage generation circuit which generates a first reference voltage and a second reference voltage which is higher than said first reference voltage by a predetermined voltage;

an output circuit which outputs said internally converted voltage on the basis of said first reference voltage output from said reference voltage generation circuit; and an output control circuit which reduces, when said internally converted voltage increases in excess of said second reference voltage generated by said reference voltage generation circuit, said excess internally converted voltage.

2. An internal voltage conversion circuit according to claim 1 wherein the difference between said second reference voltage and said first reference voltage is 0.3 V or less.

3. An internal voltage conversion circuit according to claim 1 wherein said output control circuit is formed of a combination of CMOS transistors.

4. An internal voltage conversion circuit according to claim 1, said output control circuit including:

a differential amplification circuit which receives said second reference voltage and said internally converted voltage and which outputs a voltage that varies with the difference between said second reference voltage and said internally converted voltage; and an output voltage limiting circuit which reduces said internally converted voltage according to said output voltage from said differential amplification circuit.

5. An internal voltage conversion circuit according to claim 4, said differential amplification circuit including:

an electric current source;

a first MOS transistor of a first conductivity type with a source connected to said electric current source and a gate at which said second reference voltage is applied;

a second MOS transistor of said first conductivity type with a source connected to said electric current source and a gate at which said internally converted voltage is applied;

a third MOS transistor of a second conductivity type with a drain connected to a drain of said first MOS transistor and a source connected to a power supply; and a fourth MOS transistor of said second conductivity type with a drain connected to a drain of said second MOS transistor and a source connected to said power supply;

wherein:

said third MOS transistor and said fourth MOS transistor are connected together gate to gate and said gate and said drain of said fourth MOS transistor are connected together;

said output voltage limiting circuit including:

a fifth MOS transistor of said second conductivity type with a source connected to said power supply and a gate at which the drain voltage of said first MOS transistor is applied, the drain voltage of said fifth MOS transistor becoming said internally converted voltage.

6. An internal voltage conversion circuit which is contained in a semiconductor integrated circuit and which feeds to internal elements of said semiconductor integrated circuit an internally converted voltage which is lower than an external power supply voltage, said internal voltage conversion circuit comprising:

a reference voltage generation circuit which generates a first reference voltage and a second reference voltage;

an output circuit which selects between said first reference voltage and said second reference voltage generated by said reference voltage generation circuit and which outputs said internally converted voltage on the basis of a selected reference voltage; and an operation mode selection circuit which sends to said output circuit a first operation mode signal indicating that said first reference voltage is selected and a second operation mode signal indicating that said second reference voltage is selected;

said output circuit outputs said internally converted voltage on the basis of said first reference voltage when instructed by said first operation mode signal to select said first reference voltage, and outputs said internally converted voltage on the basis of said second reference voltage when instructed by said second operation mode signal to select said second reference voltage; and said output circuit includes a differential amplification circuit and an output driver, wherein:

said differential amplification circuit receives said first reference voltage, said second reference voltage, said first operation mode signal, said second operation mode signal, and said internally converted voltage;

said differential amplification circuit outputs a voltage that varies with the difference between said first reference voltage and said internally converted voltage when instructed by said first operation mode signal to select said first reference voltage, and outputs a voltage that varies with the difference between said second reference voltage and said internally converted voltage when instructed by said second operation mode signal to select said second reference voltage; and said output driver drives said internally converted voltage according to said output voltage from said differential amplification circuit.

7. An internal voltage conversion circuit according to claim 6 wherein said first reference voltage is set higher than said second reference voltage and wherein said output circuit selects said first reference voltage when said internal element of said semiconductor integrated circuit is in a normal operation mode while said output circuit selects said second reference voltage when said internal element is in a mode of low operation rate in comparison with said normal operation mode.

8. An internal voltage conversion circuit according to claim 6, said differential amplification circuit including:

an electric current source;

a first MOS transistor of a first conductivity type with a source connected to said electric current source and a gate at which said first reference voltage is applied;

a second MOS transistor of said first conductivity type with a source connected to a drain of said first MOS transistor and a gate at which said first operation mode signal is applied;

a third MOS transistor of said first conductivity type with a source connected to said electric current source and a gate at which said second reference voltage is applied;

a fourth MOS transistor of said first conductivity type with a source connected to a drain of said third MOS transistor and a gate at which said second operation mode signal is applied;

a fifth MOS transistor of said first conductivity type with a source connected to said electric current source and a gate at which said internally converted voltage is applied;

a sixth MOS transistor of said first conductivity type with a source connected to a drain of said fifth MOS transistor and a gate connected to a power supply;

a seventh MOS transistor of a second conductivity type with a drain connected to a drain of said second MOS transistor and to a drain of said fourth MOS transistor and a source connected to said power supply; and an eighth MOS transistor of said second conductivity type with a drain connected to a drain of said sixth MOS transistor and a source connected to said power supply;

wherein said seventh MOS transistor and said eighth MOS transistor are connected together gate to gate and wherein said gate and said drain of said eighth MOS transistor are connected together;

said output driver including:

a ninth MOS transistor of said second conductivity type with a source connected to said power supply and a gate at which the drain voltage of said second MOS transistor and said fourth MOS transistor is applied, the drain voltage of said ninth MOS transistor becoming said internally converted voltage.

9. An internal voltage conversion circuit according to claim 6 wherein said output circuit is formed of a combination of CMOS transistors.

10. An internal voltage conversion circuit according to claim 6 wherein, in order to avoid a situation where said first reference voltage and said second reference voltage are selected at the same time in said output circuit, said operation mode selection circuit issues no instruction by said second operation mode signal that said second reference voltage is selected when issuing an instruction by said first operation mode signal that said first reference voltage is selected, while said operation mode selection circuit issues no instruction by said first operation mode signal that said first reference voltage is selected when issuing an instruction by said second operation mode signal that said second reference voltage is selected.

* * * * *